US009633555B2

(12) United States Patent
Machireddy et al.

(10) Patent No.: US 9,633,555 B2
(45) Date of Patent: Apr. 25, 2017

(54) REMOTE DEVICE LOCATION IDENTIFICATION

(75) Inventors: Ramana R Machireddy, Ananthapur (IN); Vishal R Mansur, Karnataka (IN); Matthew Ryan Ochs, Austin, TX (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 985 days.

(21) Appl. No.: 12/891,102

(22) Filed: Sep. 27, 2010

(65) Prior Publication Data

US 2012/0075066 A1 Mar. 29, 2012

(51) Int. Cl.

| | |
|---|---|
| ***G08B 5/22*** | (2006.01) |
| ***G08C 17/00*** | (2006.01) |
| ***G08C 21/00*** | (2006.01) |

(52) U.S. Cl.

CPC ..... *G08C 17/00* (2013.01); *G08C 21/00* (2013.01)

(58) Field of Classification Search

USPC .... 340/8.1, 9.1, 9.11, 12.23, 12.29; 709/206
See application file for complete search history.

(56) References Cited

U.S. PATENT DOCUMENTS

| | | | | |
|---|---|---|---|---|
| 5,432,775 | A | 7/1995 | Crayford | |
| 5,610,903 | A | 3/1997 | Crayford | |
| 5,991,303 | A | 11/1999 | Mills | |
| 6,359,893 | B1 | 3/2002 | Mills | |
| 7,558,874 | B1 | 7/2009 | Kodukula et al. | |
| 2002/0019725 | A1* | 2/2002 | Petite | 702/188 |
| 2007/0086450 | A1* | 4/2007 | Baumer et al. | 370/389 |
| 2012/0068822 | A1* | 3/2012 | Sheikman et al. | 340/7.2 |

OTHER PUBLICATIONS

Melvin, S.; "Endpoint Identification Using System Logs"; Google: 2005-2006.

Fllike Networks; "Network/Ethernet Test"; Google; 2008-2009.

Emulex; "Top Five Reasons for Deploying Emulex 10GbE Virtual Fabric Adapters with IBM Servers"; White Paper; Google; 2009-2010.

Paradyne; "Hotwire 8300 Endpoint Installation Instructions"; Google; Jun. 2003.

* cited by examiner

*Primary Examiner* — Brian Zimmerman
*Assistant Examiner* — Thomas McCormack
(74) *Attorney, Agent, or Firm* — Garg Law Firm, PLLC; Rakesh Garg; Tomas Tyson

(57) ABSTRACT

A method, system, and computer usable program product for remote device location identification are provided in the illustrative embodiments. A command to identify a remote device is received, at the remote device in a data processing environment. The command is included in a predetermined communication directed to the remote device. A determination is made whether the command is supported at the remote device. The remote device is identified by transmitting an identification of a location associated with the remote device.

20 Claims, 4 Drawing Sheets

*FIG. 3*

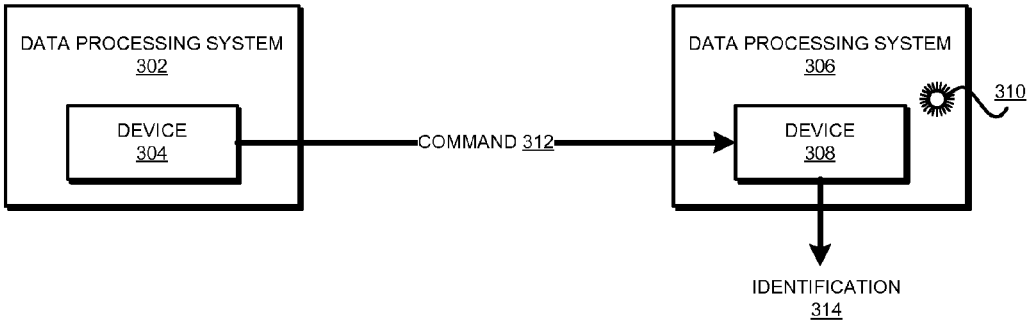

*FIG. 6*

602

| S0 | S1 | S2 | S3 | S4 | A0 | A1 | A2 | A3 | A4 | A5 | A6 | XNP | RF | ACK | NP |
|---|---|---|---|---|---|---|---|---|---|---|---|---|---|---|---|

| | |
|---|---|
| S0 – S4 | is the selector field (ex: for IEEE 802.3 it is 10000) |
| A0 – A6 | is the link ability field (ex: A0 is set for 10BaseT, A1 for 10baseT-Full and so on) |
| XNP | Extended Next Page |
| RF | Remote Fault |
| ACK | Acknowledge |
| NP | Next Page |

604

| M0 | M1 | M2 | M3 | M4 | M6 | M7 | M8 | M9 | M10 | T | ACK2 | MP | ACK | NP |
|---|---|---|---|---|---|---|---|---|---|---|---|---|---|---|

| | |
|---|---|
| M0 – M10 | Message code. 0 to 9 are currently used. 10 to 2047 is reserved for future use. One of the reserved message code could be used for remote port identification. |
| T | Toggle bits for next page. |
| ACK2 | Tell the link partner if it is able to comply with the message. 1 indicates able to comply, zero if cannot. |
| MP | Indicates message page or unformatted page |
| ACK | Indicates that a device has received its link partners code word. |
| NP | Next page if any |

REMOTE DEVICE LOCATION IDENTIFICATION

BACKGROUND OF THE INVENTION

1. Field of the Invention

The present invention relates generally to an improved data processing system, and in particular, to a computer implemented method for managing information about devices in a data processing environment. More particularly, the present invention relates to a computer implemented method, system, and computer usable program code for remote device location identification in a data processing environment where devices are coupled with each other.

2. Description of the Related Art

Data processing environments often include several data processing systems of various types communicating with each other over physical distances. Devices associated with such data processing systems and stand-alone devices may be coupled to each other, such as over a data communication network, to enable some of the functions of the data processing environment or a data processing system therein.

In certain data processing environments, such as a data center, the number of devices coupled in this manner can be large. For example, a typical data center location can have as many as a few hundred data processing systems including hundred or even thousands of devices coupled to each other. A device may be a component of a data processing system or an appliance in the data processing environment. A network adapter in a computer, a networking switch, a port on a router, and a removable card or component compatible with one or more protocols or specifications, are some examples of devices that can be coupled in this manner.

A device—a local device—may be coupled with another device or appliance—a remote device—over wired or wireless media. A device may be coupled to another device via one or more intermediary devices. A coupling between two devices via one or more intermediary devices may utilize a combination of different types of communication media. For example, a first device may be coupled to a second device via a third device. The coupling between the first and the third device may be over a wired network and the coupling between the third and the second device may be over a wireless network.

SUMMARY OF THE INVENTION

The illustrative embodiments provide a method, system, and computer usable program product for remote device location identification. An embodiment receives, at a remote device in a data processing environment, a command to identify the remote device, the command being included in a predetermined communication directed to the remote device. The embodiment determines whether the command is supported at the remote device. The embodiment identifies the remote device by transmitting an identification of a location associated with the remote device.

BRIEF DESCRIPTION OF THE DRAWINGS

The novel features believed characteristic of the invention are set forth in the appended claims. The invention itself; however, as well as a preferred mode of use, further objectives and advantages thereof, will best be understood by reference to the following detailed description of an illustrative embodiment when read in conjunction with the accompanying drawings, wherein:

FIG. 3 depicts a block diagram of an example configuration for remote device location identification in accordance with an illustrative embodiment;

FIG. 6 depicts a block diagram of an example method of sending a remote device location identification command in a message based on an existing communication standard in accordance with an illustrative embodiment.

DETAILED DESCRIPTION OF THE PREFERRED EMBODIMENT

Figure 1:
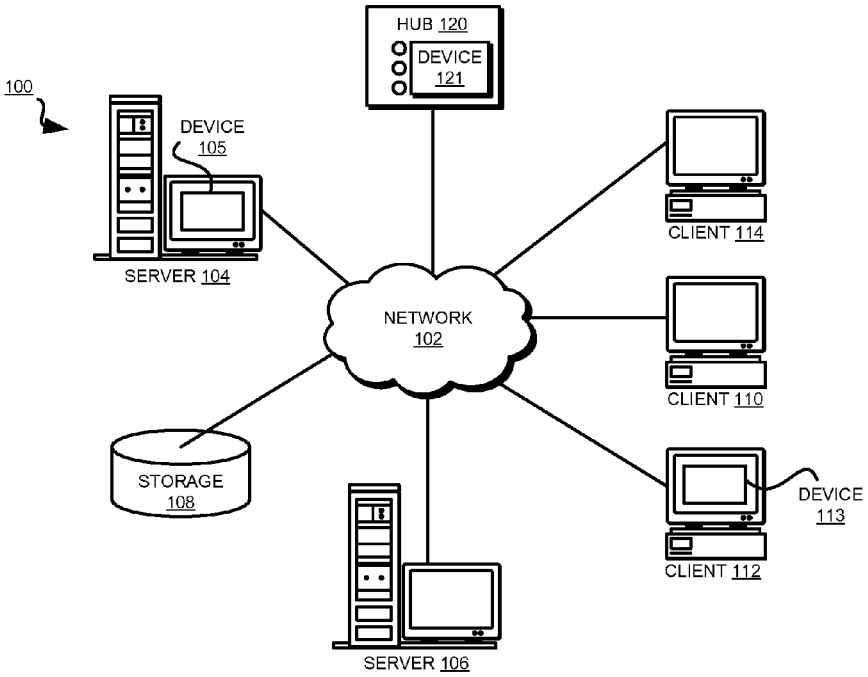
FIG. 1 depicts a pictorial representation of a network of data processing systems in which the illustrative embodiments may be implemented.

The invention recognizes that a need exists in data processing environments to identify which devices are coupled with each other. Presently, in case of certain coupled devices and certain couplings, a local device or a system associated therewith does not have a convenient way of identifying the device at the remote end of the coupling. Presently, under such circumstances, manual tracing from the local device to the device coupled at the remote end of the coupling, such as by having a person follow a communication cable, is used to identify the remote device.

For example, a local device may be a network adapter in one computer, which may be coupled to another network adapter associated with another computer in a data center. Cable tracing may be successful in identifying the remote device with some expense of time and trouble if the two devices are sufficiently close to each other, such as in the same or adjacent racks. Cable tracing can become significantly more time consuming and frustrating if the devices are located across rows of racks, or even on different floors of the data center.

The invention further recognizes that in certain data processing environments the coupling between a local and a remote device may involve intermediary devices and a variety of communication media over physical distances. In such circumstances, even the tracing method is inconvenient or impractical to identify the remote device.

For example, in the above example data center, the network adapters may be coupled to each other either directly or via several hubs, switches, routers, or other networking appliances. Cable tracing method has to begin and terminate at each such intermediate point in the coupling, further complicating the remote device location identification. Furthermore, cable tracing may not work at all in case of wireless links between two points in certain couplings.

The illustrative embodiments used to describe the invention generally address and solve the above-described problems and other problems related to identifying devices coupled with one another. The illustrative embodiments of the invention provide a method, computer usable program product, and data processing system for remote device location identification in a data processing environment. An embodiment of the invention may allow identifying a variety of devices coupled with each other over a variety of coupling methods, with or without intermediate devices in the coupling.

The illustrative embodiments are described with respect to data, data structures, and identifiers only as examples. Such descriptions are not intended to be limiting on the invention. For example, an illustrative embodiment described with respect to a particular standard may be implemented using a proprietary command structure in a similar manner within the scope of the invention.

Furthermore, the illustrative embodiments may be implemented with respect to any type of data processing system. For example, an illustrative embodiment described with respect to a computer may be implemented in an appliance, such as a storage array or a switch, within the scope of the invention. As another example, an embodiment of the invention may be implemented with respect to any type of client system, server system, platform, or a combination thereof.

The illustrative embodiments are further described with respect to certain parameters, attributes, and configurations only as examples. Such descriptions are not intended to be limiting on the invention. For example, an illustrative embodiment described with respect to numeric attribute may be implemented using an alphanumeric attribute, a symbolic attribute, or a combination thereof, in a similar manner within the scope of the invention.

An application implementing an embodiment may take the form of data objects, code objects, encapsulated instructions, application fragments, drivers, routines, services, systems—including basic I/O system (BIOS), and other types of software implementations available in a data processing environment. For example, Java® Virtual Machine (JVM®), Java® object, an Enterprise Java Bean (EJB®), a servlet, or an applet may be manifestations of an application with respect to which, within which, or using which, the invention may be implemented. (Java, JVM, EJB, and other Java related terminologies are registered trademarks of Sun Microsystems, Inc. in the United States and other countries.)

An illustrative embodiment may be implemented in hardware, software, or a combination thereof. The examples in this disclosure are used only for the clarity of the description and are not limiting on the illustrative embodiments. Additional or different information, data, operations, actions, tasks, activities, and manipulations will be conceivable from this disclosure for similar purpose and the same are contemplated within the scope of the illustrative embodiments.

Any advantages listed herein are only examples and are not intended to be limiting on the illustrative embodiments. Additional or different advantages may be realized by specific illustrative embodiments. Furthermore, a particular illustrative embodiment may have some, all, or none of the advantages listed above.

Figure 2:
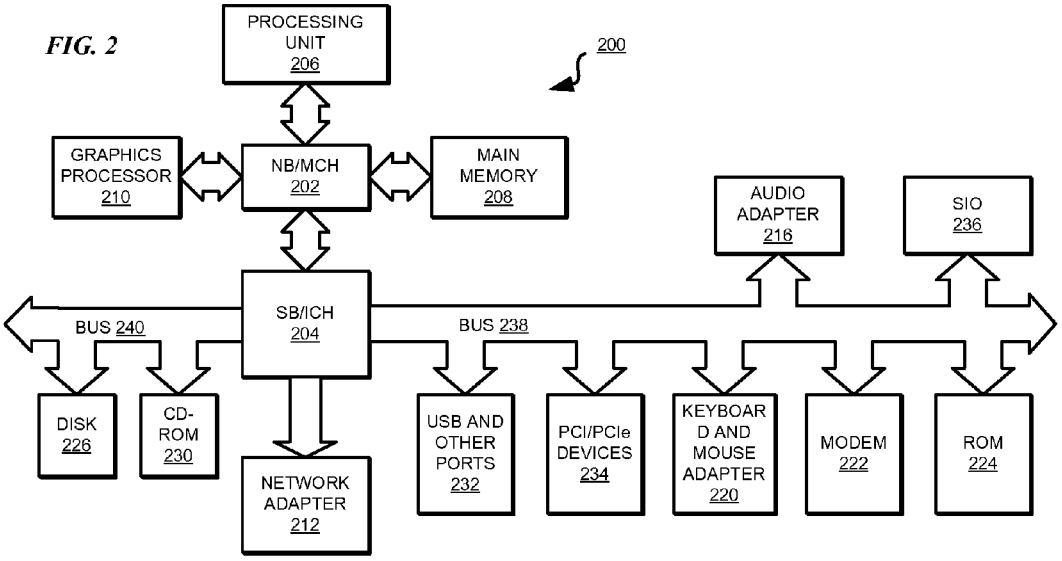
FIG. 2 depicts a block diagram of a data processing system in which the illustrative embodiments may be implemented.

With reference to the figures and in particular with reference to FIGS. 1 and 2, these figures are example diagrams of data processing environments in which illustrative embodiments may be implemented. FIGS. 1 and 2 are only examples and are not intended to assert or imply any limitation with regard to the environments in which different embodiments may be implemented. A particular implementation may make many modifications to the depicted environments based on the following description.

FIG. 1 depicts a pictorial representation of a network of data processing systems in which illustrative embodiments may be implemented. Data processing environment 100 is a network of computers in which the illustrative embodiments may be implemented. Data processing environment 100 includes network 102. Network 102 is the medium used to provide communications links between various devices and computers connected together within data processing environment 100. Network 102 may include connections, such as wire, wireless communication links, or fiber optic cables. Server 104 and server 106 couple to network 102 along with storage unit 108. Software applications may execute on any computer in data processing environment 100.

In addition, clients 110, 112, and 114 couple to network 102. A data processing system, such as server 104 or 106, or client 110, 112, or 114 may contain data and may have software applications or software tools executing thereon.

Server 104 may include device 105. Client 112 may include device 113. Hub 120 may be an example appliance that enables a coupling between device 105 and device 113 over network 102. Hub 120 may further include device 121, such as a port.

Servers 104 and 106, storage unit 108, and clients 110, 112, and 114 may couple to network 102 using wired connections, wireless communication protocols, or other suitable data connectivity. Clients 110, 112, and 114 may be, for example, personal computers or network computers.

In the depicted example, server 104 may provide data, such as boot files, operating system images, and applications to clients 110, 112, and 114. Clients 110, 112, and 114 may be clients to server 104 in this example. Clients 110, 112, 114, or some combination thereof, may include their own data, boot files, operating system images, and applications. Data processing environment 100 may include additional servers, clients, and other devices that are not shown.

In the depicted example, data processing environment 100 may be the Internet. Network 102 may represent a collection of networks and gateways that use the Transmission Control Protocol/Internet Protocol (TCP/IP) and other protocols to communicate with one another. At the heart of the Internet is a backbone of data communication links between major nodes or host computers, including thousands of commercial, governmental, educational, and other computer systems that route data and messages. Of course, data processing environment 100 also may be implemented as a number of different types of networks, such as for example, an intranet, a local area network (LAN), or a wide area network (WAN). FIG. 1 is intended as an example, and not as an architectural limitation for the different illustrative embodiments.

Among other uses, data processing environment 100 may be used for implementing a client server environment in which the illustrative embodiments may be implemented. A client server environment enables software applications and data to be distributed across a network such that an application functions by using the interactivity between a client data processing system and a server data processing system. Data processing environment 100 may also employ a service oriented architecture where interoperable software components distributed across a network may be packaged together as coherent business applications.

With reference to FIG. 2, this figure depicts a block diagram of a data processing system in which illustrative embodiments may be implemented. Data processing system 200 is an example of a computer, such as server 104 or client 110 in FIG. 1, in which computer usable program code or instructions implementing the processes may be located for the illustrative embodiments.

In the depicted example, data processing system 200 employs a hub architecture including North Bridge and memory controller hub (NB/MCH) 202 and south bridge and input/output (I/O) controller hub (SB/ICH) 204. Processing unit 206, main memory 208, and graphics processor 210 are coupled to north bridge and memory controller hub (NB/MCH) 202. Processing unit 206 may contain one or more processors and may be implemented using one or more heterogeneous processor systems. Graphics processor 210 may be coupled to the NB/MCH through an accelerated graphics port (AGP) in certain implementations. In some configurations, processing unit 206 may include NB/MCH 202 or parts thereof.

In the depicted example, local area network (LAN) adapter 212 is coupled to south bridge and I/O controller hub (SB/ICH) 204. Audio adapter 216, keyboard and mouse adapter 220, modem 222, read only memory (ROM) 224, universal serial bus (USB) and other ports 232, and PCI/PCIe devices 234 are coupled to south bridge and I/O controller hub 204 through bus 238. Hard disk drive (HDD) 226 and CD-ROM 230 are coupled to south bridge and I/O controller hub 204 through bus 240. PCI/PCIe devices may include, for example, Ethernet adapters, add-in cards, and PC cards for notebook computers. PCI uses a card bus controller, while PCIe does not. ROM 224 may be, for example, a flash binary input/output system (BIOS). In some configurations, ROM 224 may be an Electrically Erasable Programmable Read-Only Memory (EEPROM) or any other similarly usable device. Hard disk drive 226 and CD-ROM 230 may use, for example, an integrated drive electronics (IDE) or serial advanced technology attachment (SATA) interface. A super I/O (SIO) device 236 may be coupled to south bridge and I/O controller hub (SB/ICH) 204.

An operating system runs on processing unit 206. The operating system coordinates and provides control of various components within data processing system 200 in FIG. 2. The operating system may be a commercially available operating system such as AIX® (AIX is a trademark of International Business Machines Corporation in the United States and other countries), Microsoft® Windows® (Microsoft and Windows are trademarks of Microsoft Corporation in the United States and other countries), or Linux® (Linux is a trademark of Linus Torvalds in the United States and other countries). An object oriented programming system, such as the Java™ programming system, may run in conjunction with the operating system and provides calls to the operating system from Java™ programs or applications executing on data processing system 200 (Java is a trademark of Sun Microsystems, Inc., in the United States and other countries).

Instructions for the operating system, the object-oriented programming system, and applications or programs are located on storage devices, such as hard disk drive 226, and may be loaded into main memory 208 for execution by processing unit 206. The processes of the illustrative embodiments may be performed by processing unit 206 using computer implemented instructions, which may be located in a memory, such as, for example, main memory 208, read only memory 224, or in one or more peripheral devices.

The hardware in FIGS. 1-2 may vary depending on the implementation. Other internal hardware or peripheral devices, such as flash memory, equivalent non-volatile memory, or optical disk drives and the like, may be used in addition to or in place of the hardware depicted in FIGS. 1-2. In addition, the processes of the illustrative embodiments may be applied to a multiprocessor data processing system.

In some illustrative examples, data processing system 200 may be a personal digital assistant (PDA), which is generally configured with flash memory to provide non-volatile memory for storing operating system files and/or user-generated data. A bus system may comprise one or more buses, such as a system bus, an I/O bus, and a PCI bus. Of course, the bus system may be implemented using any type of communications fabric or architecture that provides for a transfer of data between different components or devices attached to the fabric or architecture.

A communications unit may include one or more devices used to transmit and receive data, such as a modem or a network adapter. A memory may be, for example, main memory 208 or a cache, such as the cache found in north bridge and memory controller hub 202. A processing unit may include one or more processors or CPUs.

The depicted examples in FIGS. 1-2 and above-described examples are not meant to imply architectural limitations. For example, data processing system 200 also may be a tablet computer, laptop computer, or telephone device in addition to taking the form of a PDA.

With reference to FIG. 3, this figure depicts a block diagram of an example configuration for remote device location identification in accordance with an illustrative embodiment. As an example, data processing system 302 may be server 104, device 304 (local device) may be implemented using device 105, data processing system 306 may be client 112, and device 308 (remote device) may be implemented using device 113 in FIG. 1 respectively.

Identification component 310 may be any suitable mechanism, method, or instrumentation to identify device 308. For example, identification component 310 may be a light emitting diode (LED) associated with device 308. Illuminating such LED may identify device 308. Identification component 310 may generally be any component capable of providing audio, visual, mechanical, tactile, or print output.

Device 304 and device 308 may be in communication with each other over a given coupling, such as by transmitting and receiving messages to and from one another. Device 304 may be modified to transmit command 312 to device 308 according to an embodiment. Command 312 may be transmitted such that device 304 transmits and device 308 receives command 312 as a part of existing or predetermined communication between the two devices. A few examples of this manner of communicating command 312 are described with respect to FIGS. 4, 5, and 6.

In response to command 312, device 308 may initiate self-identification 314. For example, in one embodiment, for identification 314, device 308 may invoke embedded or external code to transmit a signal, such as a coded value or an identifier. In another embodiment, for identification 314, device 308 may cause identification component 310 to be activated. Device 308 may cause identification component 310 to be activated and a signal to be transmitted in an embodiment.

Figure 4:
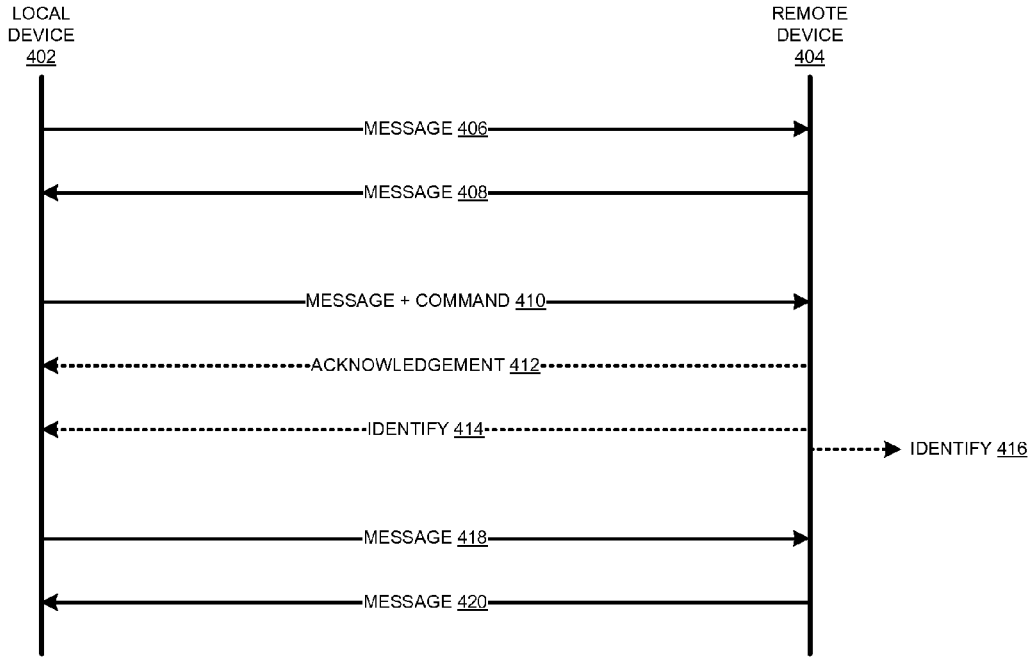
FIG. 4 depicts a messaging diagram for an example process of communicating a command to identify a remote device in accordance with an illustrative embodiment.

With reference to FIG. 4, this figure depicts a messaging diagram for an example process of communicating a command to identify a remote device in accordance with an illustrative embodiment. Local device 402 may be analogous to device 304 in FIG. 3. Remote device 404 may be analogous to device 308 in FIG. 3.

Messages 406 and 408 may be any number of messages or communications exchanged between devices 402 and 404. Message 410 may be a message that may be similar to message 406 but is modified in device 402 to include a command, such as command 312 in FIG. 3. Device 404 may optionally send acknowledgment 412 to device 402 to indicate that device 404 can comply with and respond to the command in message 410. Non-transmittal of acknowledgment 412 may indicate that device 404 cannot comply with the command, or that device 404 may comply without sending acknowledgment 412.

In other words, acknowledgment 412 may enable device 402 to perform additional functions but may not be necessary for the operation of the command of message 410. Device 404 may transmit identification 414 to device 402 or may trigger identification 416, such as by illuminating an LED.

Some additional functions that may be possible from acknowledgment 412 are now described. As an example, device 402 may transmit a first command, which may inquire about the identification capabilities of device 404. In response to such a first command, such as by acknowledgment 412, device 404 may inform device 402 about a type of identification method supported by device 404, for example, transmittal of a code or activation of an identification component. A second command from device 402 may instruct device 404 to identify itself. Device 404 may not transmit acknowledgment 412 in response to the second command. A third command from device 403 may instruct device 404 to stop the self-identification activity. Device 404 may or may not transmit acknowledgment 412 in response to the third command.

Following identification 414, 416, or both, by remote device 404 messages 418 and 420 may resume between devices 402 and 404 in the manner of messages 406 and 408. In one embodiment, messages 418 and 420 may progress asynchronously with respect to message 410, without waiting for acknowledgment 412, identification 414, identification 416, or a combination thereof.

Figure 5:
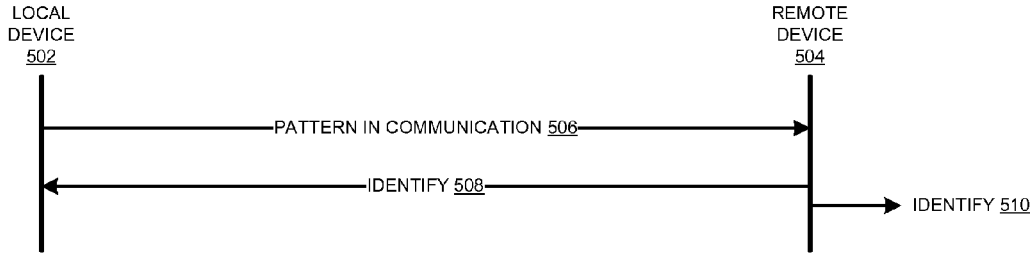
FIG. 5 depicts a messaging diagram for another example process of communicating a command to identify a remote device in accordance with an illustrative embodiment.

With reference to FIG. 5, this figure depicts a messaging diagram for another example process of communicating a command to identify a remote device in accordance with an illustrative embodiment. Local device 502 may be analogous to device 402 in FIG. 4. Remote device 504 may be analogous to device 404 in FIG. 4.

Devices 502 and 504 may be in communication with each other prior to pattern 506 in the communication according to an embodiment. Pattern 506 may be one or more predetermined patterns. Pattern 506 may include a pattern of data, for example, transmission of specific bit-pattern of Zeros and Ones. Pattern 506 may include a pattern of changes in speed of transmission, for example, altering transmitting and receiving speeds in a predetermined sequence. Pattern 506 may include a pattern of function activation, for example, invoking certain functions or causing certain functions to be invoked at remote device 504, alone, in a predetermined sequence, or with predetermined parameters.

These examples of pattern 506 are described only for the clarity of the embodiment and not as limitations on the invention. Many other patterns and combinations thereof will be apparent from this disclosure to those of ordinary skill in the art and the same are contemplated within the scope of the invention.

Device 502 may transmit pattern 506 to device 504, which may be configured to recognize pattern 506. In response to pattern 506, device 504 may transmit identification 508 to device 502, activate identification 510 locally at the remote location, or both. In one embodiment, existing communication between devices 502 and 504 need not be interrupted but only altered to accommodate pattern 506.

With reference to FIG. 6, this figure depicts a block diagram of an example method of sending a remote device location identification command in a message based on an existing communication standard in accordance with an illustrative embodiment. Messages 602 and 604 may be transmitted as parts of message 410 in FIG. 4.

Messages 602 and 604 are constructed according to a link auto-negotiation procedure in IEEE 802.3 standard. When a communication link is established between two networking devices, the link auto-negotiation procedure enables devices with different speeds to communicate necessary information to interoperate. A sequence of 16-bit "words" is exchanged between the devices during the auto-negotiation. The words (also known as pages) are well structured with definite meaning attributed to each bit or groups of bits therein as depicted.

As a part of auto-negotiation procedure, the two link partner devices transmit their link ability information in words known as Base Pages. An optional additional feature to the auto-negotiation capability is the Next Page function. A device can use Next Pages to transmit additional information beyond the device's Base Page word.

An embodiment uses this next page function in auto-negotiation between the link partner devices having auto negotiation hardware capabilities to send a command to identify the remote device in the link. According to the embodiment, the remote device interprets the command embedded in Next Page and initiates self-identification. For example, the remote device may be a device seated in a PCI bus slot. The remote device may invoke the device's PCI physical location code to identify the port at which the remote device may be operating.

As depicted, message 602 is a Base Page and message 604 is a Next Page within which the command according to an embodiment may be contained. In operation, the Base Pages and any Next Pages already in use for the link negotiation remain unchanged. A new Next Page is created by setting the "NP" bit in the Base Page or the last used Next Page for the auto-negotiation. The new Next Page is sent from the local device to the remote device containing a command for the remote device to identify the remote device's PCI slot.

As an example, the command may simply be one of the unused or reserved values for bits M0-M10. For example, the local device may set bits M0-M10 of the new Next Page to a value of 2047, a presently unused value, and the remote device may recognize this value of bits M0-M10 as a command to indentify itself.

The above example value or manner of sending the command in the new Next Page is only an example and many more methods of communicating the command using the Next Page functionality will be apparent from this disclosure to those of ordinary skill in the art. Such alternative methods are contemplated within the scope of the invention.

The remote device is configured to implement this new Next Page function and recognize the command embedded therein. The remote device is further configured to self-identify the remote device's location in some suitable manner in response to recognizing the command. For example, the remote device may be configured to invoke the remote device's PCI Hot Plug Manager. The invocation identifies the corresponding PCI slot for the port associated with the remote device by activating the LED of the PCI adapter, thus identifying the remote device.

Additional functions, as described in the description of FIG. 4, may be implemented using the features of Base Pages and Next Pages. For example, "ACK2" bit in the Next Page may be used by the remote device to communicate an acknowledgment similar to acknowledgment 412 in FIG. 4. For example, if the remote device is not a PCI device, the value of "0" in the ACK2 bit may indicate to the sender local device that the remote device does not support the new Next Page and cannot comply with the identification command.

Different unused values in the M0-M10 bits may serve as different commands. For example, value 2046 for M0-M10 in another new Next Page may inquire about a type of identification that is supported by the remote device once the remote device has acknowledged that the identification command (value 2047 in a previous new Next Page) is supported.

A PCI bus device is used only as an example remote device. The embodiment is not limited to PCI bus devices and a device may be coupled to any bus or communication channel within the scope of the invention.

The example commands, the example values, and the example bits in messages 602 and 604 are not intended to be limiting on the invention. Those of ordinary skill in the art will be able to construct additional or different commands from this disclosure and the same are contemplated within the scope of the invention.

Figure 7:
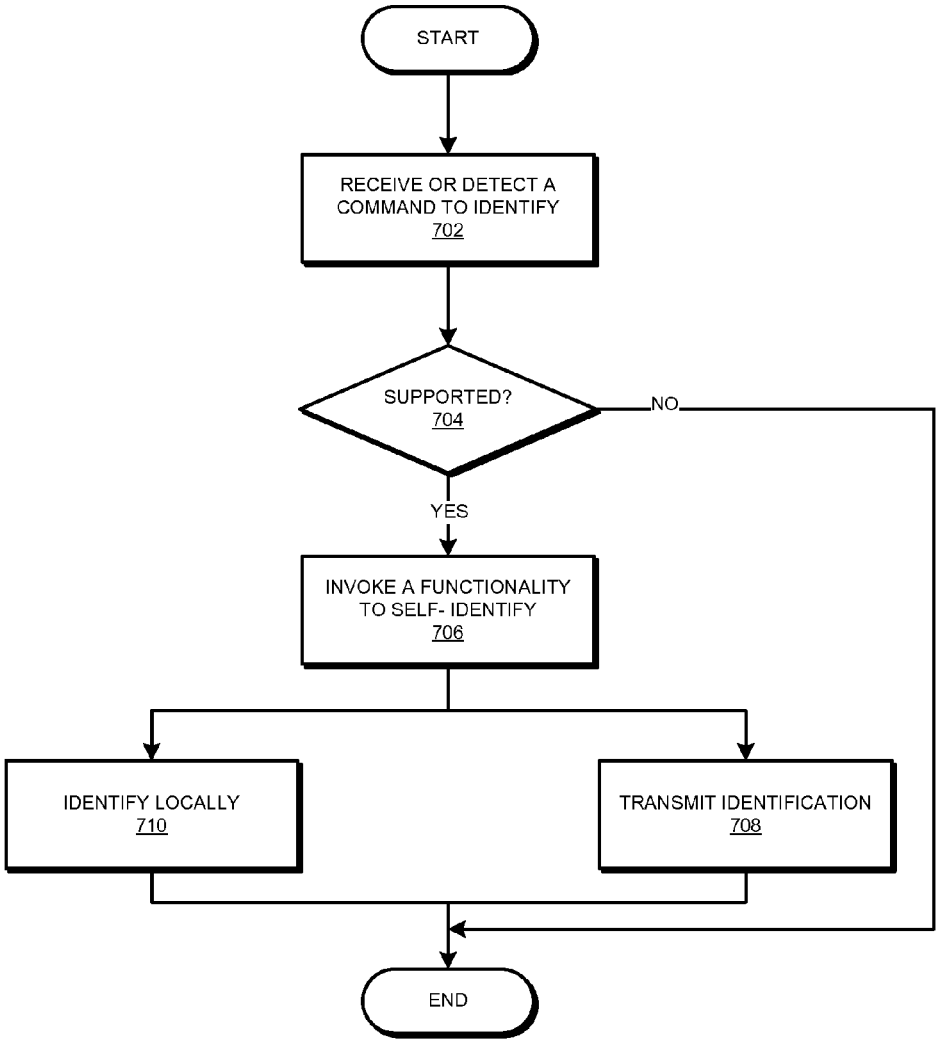
FIG. 7 depicts a flowchart of an example process of remote device location identification in accordance with an illustrative embodiment.

With reference to FIG. 7, this figure depicts a flowchart of an example process of remote device location identification in accordance with an illustrative embodiment. Process 700 may be implemented in a remote device, such as remote device 404 in FIG. 4.

Process 700 begins by receiving or detecting a command to identify (step 702). For example, process 700 may receive a command as described in message 410 in FIG. 4 or in message 604 in FIG. 6. Alternatively, process 700 may detect a command by detecting a pattern in a transmission as described with respect to FIG. 5.

Process 700 determines whether the command is supported (step 704). If the command is not supported ("No" path of step 704), process 700 ends thereafter. In one embodiment, process 700 may communicate to a sender of the command that the command is not supported, such as by setting ACK2 bit to value 0 in message 604 in FIG. 6.

If the command is supported ("Yes" path of step 704), process 700 invokes functionality to self-identify (step 706). Process 700 may identify the associated remote device by transmitting the identification (step 708), or identify the remote device locally at the remote device's location (step 710), or both. For example, process 700 may invoke embedded instructions to transmit a code to the sender of the command, invoke a Hot Swap manager function to turn ON a light, or both, or perform any other operation for a similar effect. Process 700 ends thereafter.

The components in the block diagrams and the steps in the flowcharts described above are described only as examples. The components and the steps have been selected for the clarity of the description and are not limiting on the illustrative embodiments of the invention. For example, a particular implementation may combine, omit, further subdivide, modify, augment, reduce, or implement alternatively, any of the components or steps without departing from the scope of the illustrative embodiments. Furthermore, the steps of the processes described above may be performed in a different order within the scope of the invention.

Thus, a computer implemented method, apparatus, and computer program product are provided in the illustrative embodiments for remote device location identification. Using an embodiment of the invention, a device coupled to a remote end of a coupling or link can be readily identified in a data processing environment. An embodiment can facilitate locating the remote device or identifying the location of the remote device in a physical space, in a data processing system, or both by sending a command from another device that is coupled to the remote device.

An embodiment can operate to identify the remote device and/or the device's location regardless of the number of intermediate devices in a given link. Furthermore, an embodiment can operate to identify the remote device and/or the device's location regardless of the type or types of couplings used to form the link to the remote device.

The invention can take the form of an entirely software embodiment, or an embodiment containing both hardware and software elements. In a preferred embodiment, the invention is implemented in software or program code, which includes but is not limited to firmware, resident software, and microcode.

As will be appreciated by one skilled in the art, aspects of the present invention may be embodied as a system, method, or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Further, a computer storage medium may contain or store a computer-readable program code such that when the computer-readable program code is executed on a computer, the execution of this computer-readable program code causes the computer to transmit another computer-readable program code over a communications link. This communications link may use a medium that is, for example without limitation, physical or wireless.

A data processing system suitable for storing and/or executing program code will include at least one processor coupled directly or indirectly to memory elements through a system bus. The memory elements can include local memory employed during actual execution of the program code, bulk storage media, and cache memories, which provide temporary storage of at least some program code in order to reduce the number of times code must be retrieved from bulk storage media during execution.

A data processing system may act as a server data processing system or a client data processing system. Server and client data processing systems may include data storage media that are computer usable, such as being computer readable. A data storage medium associated with a server data processing system may contain computer usable code. A client data processing system may download that computer usable code, such as for storing on a data storage medium associated with the client data processing system, or for using in the client data processing system. The server data processing system may similarly upload computer usable code from the client data processing system. The computer usable code resulting from a computer usable program product embodiment of the illustrative embodiments may be uploaded or downloaded using server and client data processing systems in this manner.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to explain the principles of the invention, the practical application, and to enable others of ordinary skill in the art to understand the invention for various embodiments with various modifications as are suited to the particular use contemplated.

What is claimed is:

1. A computer implemented method for remote device location identification, the computer implemented method comprising:

receiving, at a remote device in a data processing environment, a command to identify the remote device, the command being included in a predetermined communication directed to the remote device, wherein the predetermined communication is to cause another operation distinct from the identification of the remote device, wherein the command is embedded in a first Next page of a link auto-negotiation procedure by setting a set of bits in the first Next page to a first value, wherein setting by the remote device the set of bits in the first Next page to a second value causes the remote device to provide information about a type of identification supported at the remote device, wherein the first Next page is a new page added to a page in the predetermined communication, and wherein the first value and the second value are unused in the link auto-negotiation procedure;

determining, at the remote device, whether the command is supported at the remote device;

setting, by the remote device, responsive to the determining being affirmative, a bit in a second Next page in the link auto-negotiation procedure to indicate support for the command during the link auto-negotiation procedure; and identifying by the remote device, responsive to the determining being affirmative, the remote device by transmitting an identification of a location associated with the remote device.

2. The computer implemented method of claim 1, further comprising:

performing, at the remote device, the other operation according to the predetermined communication.

3. The computer implemented method of claim 1, wherein the transmitting the identification is activating a physically perceivable identification of a physical location of the remote device at the physical location of the remote device.

4. The computer implemented method of claim 1, wherein the receiving comprises:

detecting a pattern in the predetermined communication, wherein the pattern in a predetermined sequence of transmissions directed to the remote device.

5. The computer implemented method of claim 1, the remote device is a network appliance, and wherein the transmitting the identification is identifying the remote device at the location of the remote device.

6. The computer implemented method of claim 1, wherein the identification identifies a physical location of the remote device.

7. A computer usable program product comprising a non-transitory computer usable storage device including computer usable code for remote device location identification, the computer usable code comprising:

computer usable code for receiving, at a remote device in a data processing environment, a command to identify the remote device, the command being included in a predetermined communication directed to the remote device, wherein the predetermined communication is to cause another operation distinct from the identification of the remote device, wherein the command is embedded in a first Next page of a link auto-negotiation procedure by setting a set of bits in the first Next page to a first value, wherein setting by the remote device the set of bits in the first Next page to a second value causes the remote device to provide information about a type of identification supported at the remote device, wherein the first Next page is a new page added to a page in the predetermined communication, and wherein the first value and the second value are unused in the link auto-negotiation procedure;

computer usable code for determining, at the remote device, whether the command is supported at the remote device;

computer usable code for setting, by the remote device, responsive to the determining being affirmative, a bit in a second Next page in the link auto-negotiation procedure to indicate support for the command during the link auto-negotiation procedure; and computer usable code for identifying by the remote device, responsive to the determining being affirmative, the remote device by transmitting an identification of a location associated with the remote device.

8. The computer usable program product of claim 7, further comprising:

computer usable code for performing, at the remote device, the other operation according to the predetermined communication.

9. The computer usable program product of claim 7, wherein the transmitting the identification is activating a physically perceivable identification of a physical location of the remote device at the physical location of the remote device.

10. The computer usable program product of claim 7, wherein the receiving comprises:

computer usable code for detecting a pattern in the predetermined communication, wherein the pattern in a predetermined sequence of transmissions directed to the remote device.

11. The computer usable program product of claim 7, the remote device is a network appliance, and wherein the transmitting the identification is identifying the remote device at the location of the remote device.

12. The computer usable program product of claim 7, wherein the identification identifies a physical location of the remote device.

13. The computer usable program product of claim 7, wherein the computer usable code is stored in a non-transitory computer readable storage medium in a data processing system, and wherein the computer usable code is transferred over a network from a remote data processing system.

14. The computer usable program product of claim 7, wherein the computer usable code is stored in a non-transitory computer readable storage medium in a server data processing system, and wherein the computer usable code is downloaded over a network to a remote data processing system for use in a non-transitory computer readable storage medium associated with the remote data processing system.

15. A data processing system for remote device location identification, the data processing system comprising:

a non-transitory storage device, wherein the storage device stores computer usable program code; and a processor, wherein the processor executes the computer usable program code, and wherein the computer usable program code comprises:

computer usable code for receiving, at a remote device in a data processing environment, a command to identify the remote device, the command being included in a predetermined communication directed to the remote device, wherein the predetermined communication is to cause another operation distinct from the identification of the remote device, wherein the command is embedded in a first Next page of a link auto-negotiation procedure by setting a set of bits in the first Next page to a first value, wherein setting by the remote device the set of bits in the first Next page to a second value causes the remote device to provide information about a type of identification supported at the remote device, wherein the first Next page is a new page added to a page in the predetermined communication, and wherein the first value and the second value are unused in the link auto-negotiation procedure;

computer usable code for determining, at the remote device, whether the command is supported at the remote device;

computer usable code for setting, by the remote device, responsive to the determining being affirmative, a bit in a second Next page in the link auto-negotiation procedure to indicate support for the command during the link auto-negotiation procedure; and computer usable code for identifying by the remote device, responsive to the determining being affirmative, the remote device by transmitting an identification of a location associated with the remote device.

16. The data processing system of claim 15, further comprising:

computer usable code for performing, at the remote device, the other operation according to the predetermined communication.

17. The data processing system of claim 15, wherein the transmitting the identification is activating a physically perceivable identification of a physical location of the remote device at the physical location of the remote device.

18. The data processing system of claim 15, wherein the receiving comprises:

computer usable code for detecting a pattern in the predetermined communication, wherein the pattern in a predetermined sequence of transmissions directed to the remote device.

19. The data processing system of claim 15, the remote device is a network appliance, and wherein the transmitting the identification is identifying the remote device at the location of the remote device.

20. The data processing system of claim 15, wherein the identification identifies a physical location of the remote device.

* * * * *